US008834295B2

(12) United States Patent
Kondo et al.

(10) Patent No.: US 8,834,295 B2
(45) Date of Patent: Sep. 16, 2014

(54) IRON GOLF CLUB AND METHOD FOR MANUFACTURING THE SAME

(75) Inventors: Rui Kondo, Niigata (JP); Tamotsu Hasegawa, Niigata (JP)

(73) Assignee: K. K. Endo Seisakusho, Tsubame-shi (JP)

( * ) Notice: Subject to any disclaimer, the term of this patent is extended or adjusted under 35 U.S.C. 154(b) by 262 days.

(21) Appl. No.: 13/397,818

(22) Filed: Feb. 16, 2012

(65) Prior Publication Data

US 2012/0214612 A1 Aug. 23, 2012

(30) Foreign Application Priority Data

Feb. 17, 2011 (JP) ..... 2011-032660

(51) Int. Cl.
*A63B 53/04* (2006.01)
*B21K 17/00* (2006.01)

(52) U.S. Cl.
CPC ..... *B21K 17/00* (2013.01); *A63B 53/047* (2013.01)
USPC ..... 473/349; 473/350; 473/240

(58) Field of Classification Search
USPC ..... 473/349, 350, 240
See application file for complete search history.

(56) References Cited

U.S. PATENT DOCUMENTS

| | | | | |
|---|---|---|---|---|
| 5,692,287 | A * | 12/1997 | Nakamura et al. | 29/558 |
| 2003/0126734 | A1* | 7/2003 | Takeda | 29/557 |
| 2003/0203766 | A1* | 10/2003 | Sano et al. | 473/324 |
| 2005/0115296 | A1* | 6/2005 | Sato | 72/354.8 |
| 2009/0078957 | A1* | 3/2009 | Hoshina | 257/98 |

FOREIGN PATENT DOCUMENTS

| | | | |
|---|---|---|---|
| JP | 2001-029522 | A | 2/2001 |
| JP | 2004-208929 | A | 7/2004 |
| JP | 2004208929 | * | 7/2004 |

* cited by examiner

*Primary Examiner* — Benjamin Layno
(74) *Attorney, Agent, or Firm* — Westerman, Hattori, Daniels & Adrian, LLP

(57) ABSTRACT

An iron golf club is one made of metal material, which is manufactured integrally through press working and gives dedication to improvement of golf club design. The head (1) has a concave portion (4) surrounded by a convex portion (6) in the backside portion (3) behind the face portion (2). Treatment for making a mirror surface is applied to the bottom portion (5) of this concave portion through press working with a fixed die (11) having a surface roughness finer than the mirror surface for which treatment for making a mirror surface is to be performed and a movable die (10). Press working of this bottom portion can be also performed through treatment for making a mirror surface with a liner member (17).

4 Claims, 6 Drawing Sheets

IRON GOLF CLUB AND METHOD FOR MANUFACTURING THE SAME

FIELD OF THE INVENTION

The present invention relates to an iron golf club having a groove subjected to mirror surface treatment on the backside of the head and a method for manufacturing the same. More specifically, the present invention relates to an iron golf club, in which mirror surface treatment is applied at the bottom of the groove formed in the center portion on the backside of the club head, and a method for manufacturing the same.

Iron golf clubs with various configurations have been proposed and supplied for practical use. The head of an iron golf club has a body configuration having a face portion with score lines and backside portion at the back side of the face portion. Especially, various shapes and constructions of the backside portion are proposed and used in view of function or design. As a shape of the backside portion, a type is known in which substantially central portion is formed to be a groove. The iron golf club of this type has an object in increasing the moment of inertia by redistributing its mass to the periphery of the backside. Additionally to this, improvement has been made in recent for the purpose of upgrading performance in design of the backside portion and comes to be remarkable. It is known that mirror surface finishing is especially favored for design.

Further, a golf club has come to be known in which improvement is made in view of whole body design taking upgrading of performance and design into consideration through attaching a mark plate to the backside portion or changing the shape. For example, a golf club is known which is fabricated through connecting a face portion and a body so as to be integrated in the later stage, wherein the backside surface of the face portion is formed to be the bottom surface of a cavity, a part of the portion is made to be a mirror surface and then is caused to be attached to a body with 3-D configuration, after which characters or marks provided on the wall surface on the body side are displayed through reflection on this mirror surface (see e.g. Japanese Patent Application Laid-open No. 2004-208929: Patent Document 1).

While this golf club has its part formed to be a mirror surface, the flat part on the backside of the face portion is made to be a mirror surface. In the final stage, this face portion is attached to the body through welding to be integrated, so that the mirror surface portion is disposed in the cavity. While, on the other hand, a golf club is conventionally known, in which a face portion and a backside portion are integrated in the early stage, and this is typical one used in common, characters and marks are formed in practice through pressing on the backside face.

For example, a golf club is known in which a design is formed on the backside portion of an iron golf club fabricated as a product of precision forging through pressing established in the metallic mold of precision forging so that a design of characters or figures is formed as relieved characters or figures (see e.g. Japanese Patent Application Laid-open No. 2001-29522: Patent Document 2).

SUMMARY OF THE INVENTION

As described above, design improvement is made conventionally in the backside portion. However, because the configuration of the backside portion is of great varieties, especially application of forming a mirror surface is affected by the shape of the backside portion. In other words, application of forming a mirror surface is restricted to one which has such a shape of the surface as to be worked easily. In the method for manufacturing a golf club, in which a face portion is attached to a body to be integrated, the backside surface of the face portion before it is attached is a flat shape, thus providing a configuration for which mirror surface working can be performed easily.

Especially in the case of the type which has a concave portion and a convex portion surrounding the concave portion formed integrally, the technique for applying a mirror surface on the concave portion had difficulty because of restraint in working. While working for forming a mirror surface is performed through polishing, the concave portion can not be polished. Consequently, there were only such a method in which satin surface is formed through sand blasting or shot blasting or a method in which a member is divided and working for forming a mirror surface is performed as mentioned above. Further, an attached mark plate has possibility of detaching and can not help increasing its working steps and expense for manufacturing.

The present invention has been made under the technical background as mentioned above and attains the following objects. It is an object of the present invention to provide an iron golf club, which, as a product with an integrated constitution, has a backside concave portion provided with a mirror surface through press working, and a method for manufacturing the same. It is another object of the present invention to provide an iron golf club, which can be manufactured in a short period and with a low cost, and a method for manufacturing the same.

The present invention has the following features in order to attain the above mentioned objects.

The iron golf club according to the present invention 1 is characterized in being an iron golf club made of metal material in which the head has a concave portion surrounded by a convex portion in the backside portion of the face portion, at least the convex portion and the concave portion are formed integrally and at least a part of the bottom surface of the concave portion is a mirror surface.

The iron golf club according to the present invention 2 is characterized in being an iron golf club according to the present invention 1, wherein the mirror surface is formed on a part of the bottom surface and the mirror surface has a surface having a value no less than 400 GU in 20° according to JIS Z8741 which defines standards for glossiness of a mirror surface and measurement of glossiness.

The method for manufacturing an iron golf club according to the present invention 3 is characterized in being a method for manufacturing an iron golf club according to the present invention 1 or 2, wherein the mirror surface is formed through plastic working of the bottom surface.

The method for manufacturing an iron golf club according to the present invention 4 is characterized in being a method for manufacturing an iron golf club according to the present invention 3, wherein the mirror surface is obtained through press working with a die (16, 18) having a surface roughness finer than the mirror surface for which treatment for making a mirror surface is to be performed.

The method for manufacturing an iron golf club according to the present invention 5 is characterized in being a method for manufacturing an iron golf club according to the present invention 4, wherein a die face (15) with treatment for making a mirror surface applied is provided in the die (11) for the backside of the head for forming an iron golf club, press working is performed with the die face (15) and the die face of the movable die (10) on the side of the face portion and the die face with treatment for making a mirror surface applied applies treatment for making a mirror surface on the backside portion (3), and wherein a liner member (11) is provided in the die face (18) of the die (11) of the backside of the head so as to be movable relative thereto forward and backward and the press working is performed on the bottom surface (5) with the liner member (17) to apply treatment for making a mirror surface on the backside portion (3).

As explained above, in the method for manufacturing an iron golf club according to the present invention, treatment for making a mirror surface is applied, with a die face having a surface roughness finer than the mirror surface, on the bottom surface of the backside portion of an integrated golf club head. This allows manufacturing of the golf club to be made in a short period and an iron golf club having a mirror surface in the concave portion can be obtained with low expense.

DETAILED DESCRIPTION OF PREFERRED EMBODIMENTS

Embodiments of an iron golf club according to the present invention will be explained referring to the attached drawings. The general constitution of the iron golf club is as follows. The iron golf club is composed as a basic constitution mainly by a head and a shaft. The head is made of metal material such as low-carbon steel as S20C or the like, stainless steal or alloy of titanium etc. The head has a face for hitting a ball formed on the front side, a sole formed in the lower portion, a heel formed on one side, a shaft attaching portion formed in the upper portion of the heel for connecting a shaft therewith, a top formed in the upper portion and a toe formed on the other side.

Further, on the back side of the head, a backside portion (also referred to as "a cavity back") is formed to have a concave portion in the location substantially mating with the face. A plurality of score lines as linear grooves are formed on the face in the lateral direction. The score lines have a shape in section, such as a V-shape, a U-shape, a trapezoidal shape or the like. This sectional shape is of groove type formed to be a concave portion on the face through press working with a forging die called linear type, through machining or the like. Also, a mark denoting the club number is formed on the sole. This mark denoting the club number is formed to be a concave portion on the sole through press working.

Figure 1:
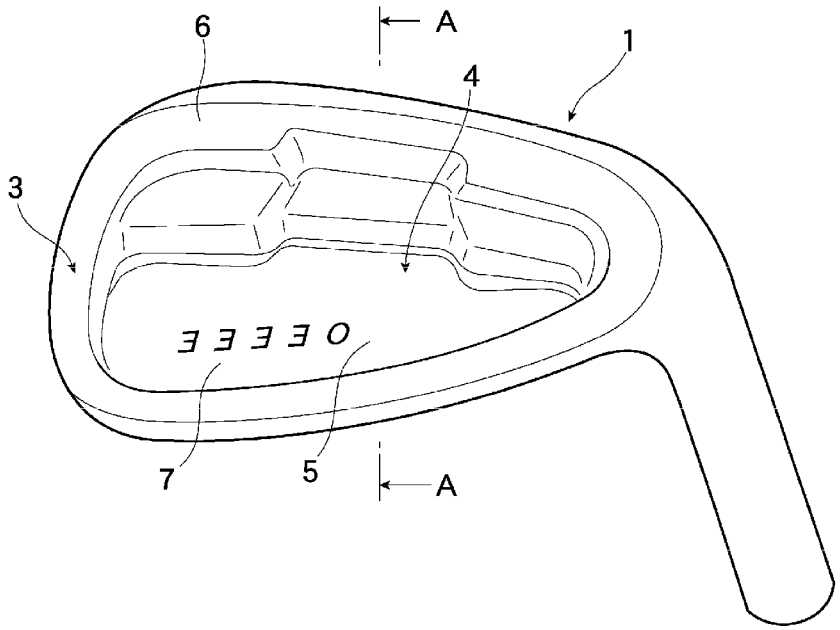
FIG. 1 is a front view showing the backside surface of an iron golf club head.
Figure 2:
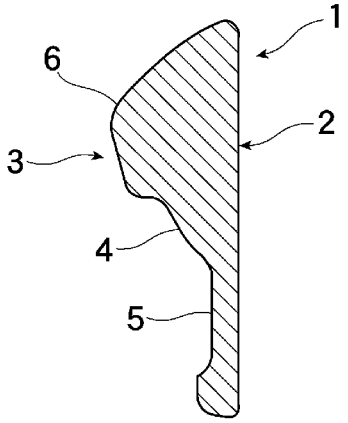
FIG. 2 is a view showing a surface configuration, in which the bottom portion of the cavity is parallel to the face, in a section taken along A-A of FIG. 1.

In the next, embodiment concerning with manufacturing of an iron golf club head according to the present invention will be explained. FIG. 1 is a front view of an iron golf club head 1 viewed from the backside. FIG. 2 is a sectional view taken along A-A of FIG. 1. As shown, this head 1 has an integrated constitution made of the same material and is formed through die forging explained later. On the surface of the face portion 2 of this head 1, score lines (not shown) are formed through press working. The backside of this face portion 2 constitutes a backside portion.

A concave portion 4 is formed in the center of the backside portion 3 and a bottom surface 5 is formed in a part of the bottom portion of the concave portion to approach most to the surface of the face portion. This bottom surface 5 is parallel to the surface of the face portion 2. On the periphery of the concave portion 4, convex portion 6 is formed so as to surround the concave portion 4. The bottom surface 5 is subjected to treatment for making a mirror surface through press working explained later. This treatment for making a mirror surface is to provide a surface having a value no less than 400 GU in 20° according to JIS Z8741 (Japanese Industrial Standard for mirror surface glossiness) which defines standards for glossiness of a mirror surface and measurement of glossiness. Further, characters or marks 27 or the like are formed on the bottom surface 5 which has been subjected to treatment for making a mirror surface through press working.

Figure 3:
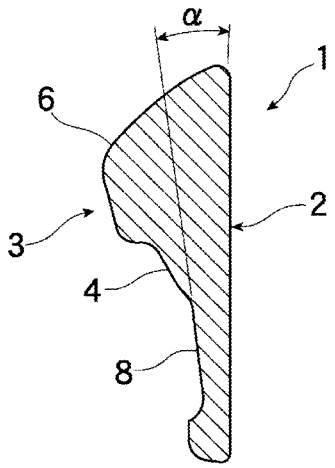
FIG. 3 is a sectional view showing a surface configuration according to another embodiment, in which the bottom portion of the cavity is inclined to the face.

In the next, another embodiment will be explained as a modified example relating to the bottom surface. As seen in FIG. 3 showing this example, the bottom surface 8 is constituted so as to be inclined to the surface of the face portion 2 by an angle of $\alpha$ degrees. In such a manner, the treatment for making a mirror surface through press working may be performed also on a surface inclined to the surface of the face portion.

Figure 4:
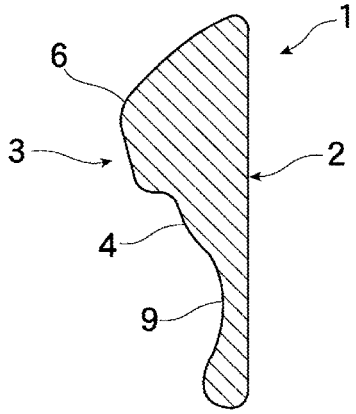
FIG. 4 is a sectional view showing a surface configuration according to still another embodiment, in which the bottom portion of the cavity has a curved surface.

Still another embodiment as a modified example relating to the bottom surface will be explained. As seen in FIG. 4 showing this example, the bottom surface is a curved surface. Because the die face is convex, working of making a mirror surface can be performed by applying techniques known for polishing lenses. Though a concave curved surface is shown, a convex curved surface can also be used. In the bottom surface of a curved surface, more original designing can be made.

Further, it is also possible to form the bottom surface to be a mirror surface having a diamond-cut configuration, though it is not shown. This owes to the fact that working for making a mirror surface can be performed easily along with press working. That is, because the die face is convex, working for making a mirror surface at an altered angle can be performed. Also, while explanation was made such that a bottom surface 5 is formed as a part of the bottom portion, whole of the bottom surface including step-like portions can be formed to be a mirror surface in certain shapes of the concave portion 4. These explained treatment for making a mirror surface is performed taking technical matters into consideration relating to upgrading of hitting performance such as weight or disposition of the head and is not performed considering only design of the head without considering matters relating to upgrading of technical performance.

Figure 5:
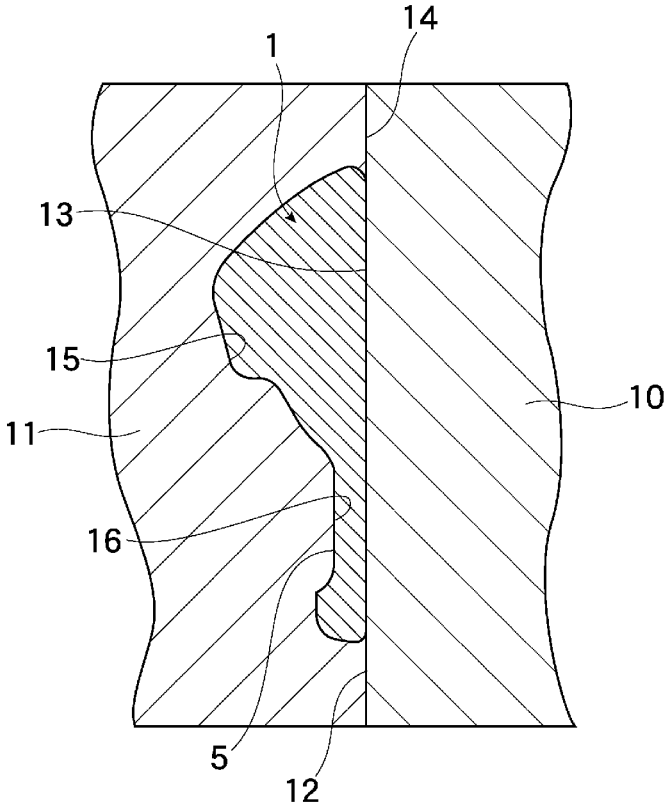
FIG. 5 is a sectional view showing a constitution of a forging die for manufacturing an iron golf club head.

In the next, embodiment of a method for manufacturing an iron golf club will be explained. FIG. 5 is a sectional view showing a constitution of forging dies for manufacturing an iron golf club head 1 through die forging. The forging dies are constituted by a movable die 10 as one die part and a fixed die 11 as the other die part confronting to the former. A face-forming die face 13 for forming the face portion 2 is formed on the split surface 12 of the movable die 10 in a concaved configuration on the movable die 10. A backside-forming die face 15 for forming the backside portion 3 of the body as a main portion of the head 1 is formed on the split surface 14 of the fixed die 11.

This backside-forming die face 15 includes a portion for forming the above mentioned concave portion 4 of the backside portion 3, in the center of which a bottom-forming die face 16 for forming the bottom surface 5 of the concave portion 4 is formed. The top surface of the bottom-forming die face 16 on the side of the face portion serves as a face for forming a mirror surface. This top surface of the bottom-forming die face 16 is a surface parallel to the split surface 14 of the fixed die 11. This top surface is on a convex potion in the center of the concave portion 4. This top surface serves as a portion for forming the bottom surface 5 of the backside portion 3 of the head 1.

This top surface is a surface having a surface roughness finer than the surface roughness of the mirror surface of the bottom surface 5 for which treatment for making a mirror surface is performed. This top surface is a portion forming a part of a convex portion within the above mentioned backside die surface 15 for forming the concave portion 4. Consequently, because the die is constituted so that there is no convex portion around the bottom-forming die face 16, working for making a mirror surface of the top surface can be made easily. When press working is performed with the movable die 10 and the fixed die 11 which constitute forging dies having such a configuration, working for making a mirror surface is done through plastic deformation of the bottom surface 5 of the backside portion 3 of the head 1 under pressing action.

Press working of characters or marks can be made on this bottom surface 5 for which treatment for making a mirror surface is done. Also, before the treatment for making a mirror surface, preliminary treatment is applied to the bottom portion 5 of the head, which is subjected to pressure by this top surface, so that treatment for making a mirror surface can be made smoothly. In this embodiment, treatment of shot blast is performed on the material of the head before its press working. If necessary, etching or coining may be also made. It is more preferable that the situation before press working is smoother, because glossiness after press working becomes higher. In this, it is also preferable to make surface treatment on the mirror surface portion. This can be said, for example, from upgrading of glossiness through smoothing by plating. With such treatment for making a mirror surface through press working, manufacturing of the golf club head can be made in a short period and there is no need for another step for making a mirror surface, thus manufacturing being performed with low expense.

Figure 6:
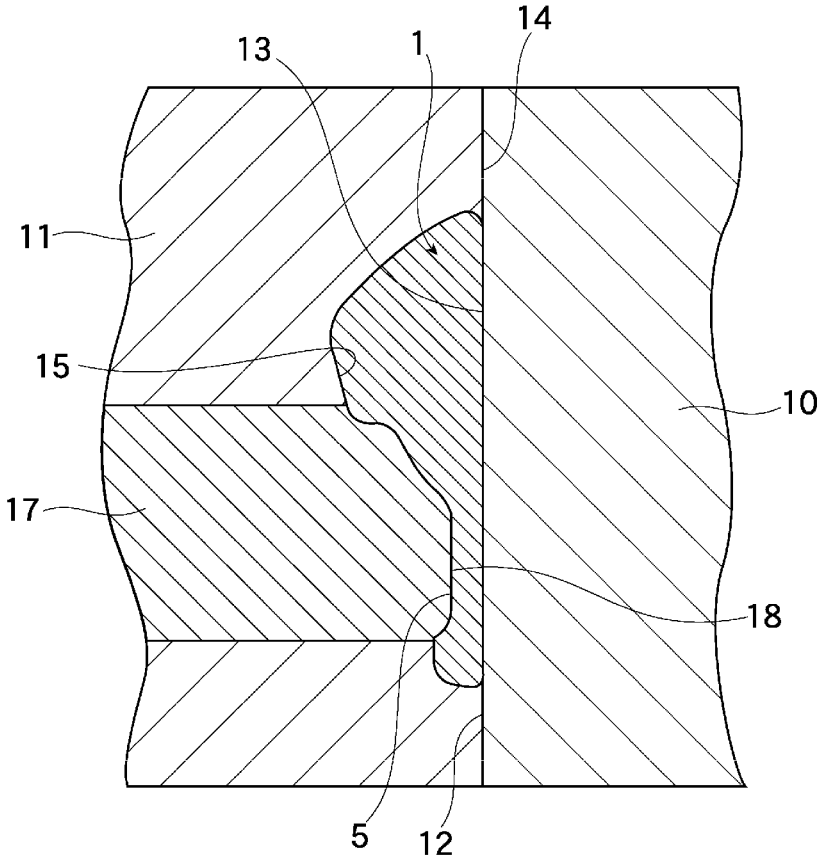
FIG. 6 is a sectional view showing a constitution of a forging die for manufacturing an iron golf club head according to another embodiment and showing die forging with a liner member.
Figure 7:
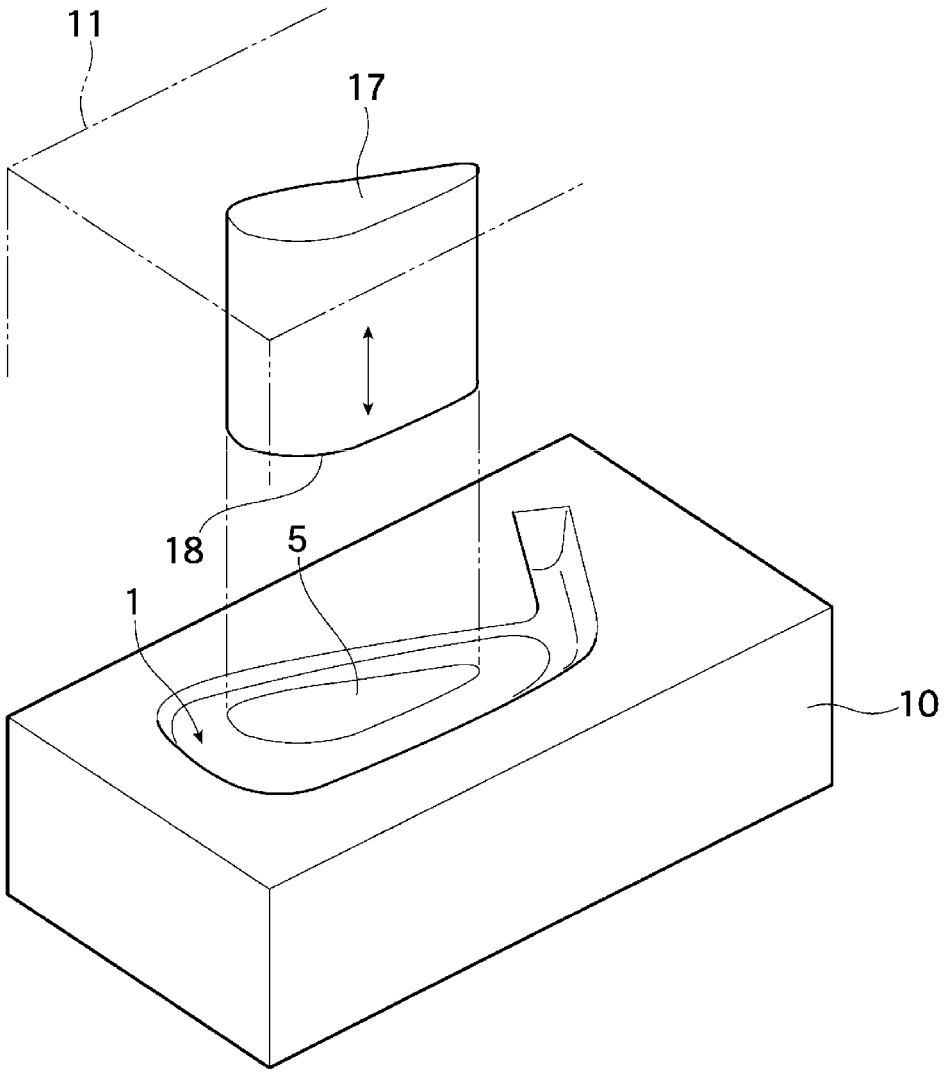
FIG. 7 is an explanatory perspective view showing the liner member in FIG. 6 in a separated state.
Figure 8:
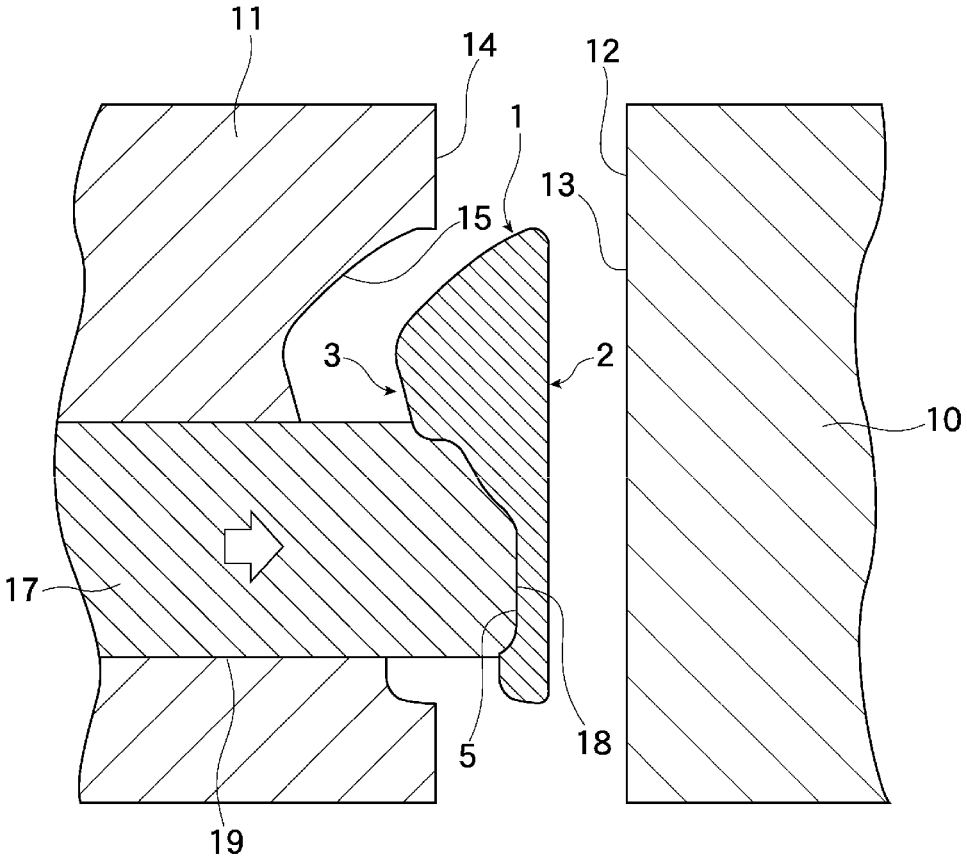
FIG. 8 is a sectional view showing the forging die with a liner member in FIG. 6 in an opened state.

In the next, another embodiment of a method for manufacturing a golf club head will be explained. In this example, forging dies are used in which a part of the fixed die 11 for forming the bottom portion 5 of the head 1 is substituted by a liner member 17 which can move forward and backward through relative movement. FIG. 6 is a sectional view showing an example of the dies for die forging. FIG. 7 is an explanatory perspective view showing the liner member in a separated state. FIG. 8 is a sectional view showing the forging dies with a liner member in an opened state. Its basic constitution is common with that of the above mentioned embodiment.

As shown in FIG. 6, a liner member 17 for forming the bottom portion 5 is provided to be movable forward and backward in the center within the backside-forming die face 15 of the fixed die 11. The top portion 18 of this liner member 17 has a similar shape as the above mentioned bottom-forming die face 16. The liner member 17 can move forward and backward with its sides 19 guided by the fixed die 11. While the direction of this guide depends on the configuration of the backside-forming die face 15, the direction is set to be orthogonal to the surface constituting the bottom surface 5 in this embodiment.

Consequently, the guide direction is orthogonal to the split surface 14. FIG. 7 is an explanatory perspective view showing the liner member 17 in a separated state and showing schematically its constitution movable forward and backward relative to the movable die 10. As explained above, the liner member 17 is movable forward and backward as a die member for forming only the concave potion 4 of the head 1 including the portion to be treated for making a mirror surface. As a consequence, a constitution is allowed in this example in which the whole top portion 18 of the liner member 17 as a die has a convex shape.

Therefore, it is possible to perform working for making a mirror surface on the top portion 18 without any interference in its periphery. The working can be made easily so that this top portion 18 is brought to have a worked surface finer than the mirror surface to be treated for making a mirror surface. This embodiment amounts to allowing the working for making a mirror surface to be made easily. Further, while the direction of forward and backward movement of the liner member 17 is set to be orthogonal to the surface of the bottom surface 5 in this constitution of the die, the direction may be set to be of another angle. After press working has been made with such a constitution, the forging die brought to an opened state shown in FIG. 6 and the head 1 is produced in which treatment for making a mirror surface has been done within the concave portion 4.

With the above explained constitution, the iron golf club according to the present invention allows working for making a mirror surface to be made on the concave portion of the backside portion of the head. Manufacturing of golf clubs involves mass production. Conventionally treatment for making a mirror surface could be made through polishing only on the convex portion of the head. The present invention have realized industrial treatment for making a mirror surface on the bottom surface of a concave portion, which was conventionally difficult to be realized, with techniques of die forging by press working. In the present invention, a head is intended to be such that the concave portion of the backside portion is surrounded by the convex wall. In other words, a head to be dealt is such that it is difficult to perform working for making a mirror surface on a concave portion in the later step, as mentioned above.

While, corresponding to head configuration, there is a case in which a part of the convex wall surrounding the concave portion is concave, such configuration of the head is included in the head intended by the present invention as that having a concave portion surrounded by the convex portion, if it is one which could not be conventionally worked for making a mirror surface. It need not say that the present invention is not limited to the explained embodiments. For example, there is varnishing known as a kind of plastic working for obtaining a furnished smooth surface with a tool pressed against a surface after machining. This is a method of working in which varnishing is performed with a varnishing tool attached to the tool head of a machine tool such as a machining center, the movement of the tool being numerically controlled. This method of working has an advantage in ability to correspond to a complex configuration of the concave portion of the backside portion.

Results of measurement of mirror surfaces are shown in Table 1. This measurement is done with recognition sensing defined through strength of reflected light on a mirror surface based on JIS Z8742 (Japanese Industrial Standard for glossmeter). Press working was performed with the surface situation of the bottom surface 5 before press working changed and with the mirror surface situation of the die unchanged, then glossiness of the bottom surface 5 was measured. Test products No. 1 to 3, in which surface situation before press working was smooth, were recognized to be mirror surfaces. Test products No. 4 and 5, in which surface situation before press working was rough, were not recognized to be mirror surfaces after press working. No. 6 and 7 are examples for comparison as conventional techniques. In this, the test products were subjected to treatment of plating.

TABLE 1

Results of Measurement of Glossiness of Mirror surface

| Test Product No. | Values of Glossiness (in GU) 20° | 60° | 86° |
|---|---|---|---|
| 1 By the Present Invention | 1198.0 | 889.0 | 109.0 |
| 2 By the Present Invention | 508.0 | 481.0 | 107.0 |
| 3 By the Present Invention | 461.0 | 409.0 | 101.0 |
| 4 By Example for Comparison | 208.0 | 253.0 | 76.2 |
| 5 By Example for Comparison | 102.0 | 204.0 | 54.9 |
| 6 With Shot Blast of 0.3 mm(Prior Art) | 7.0 | 42.0 | 7.9 |
| 7 With Sand Blast #180 | 1.1 | 5.6 | 33.3 |

Condition of Working and Measurement
1. Measurement Device: MULTI FLOSS 268 (by Konica Minolta Co.Ltd.)
2. Standard of Measurement: JIS Z8741
3. Material of Die: SKD-61
4. Surface Roughness of Mirror Portion of Die: (Mean Value for 3 Points) Ra = 0.08 μm, Rz = 0.63 μm, Rmax = 1.37 μm
5. Glossiness of Mirror Portion of Die: 20° corresponding to 1080GU, 60° corresponding to 550GU, 85° corresponding to 118GU

What is claimed is:

1. A method for manufacturing an iron golf club head comprising a face portion having a backside portion, the iron golf club head made of metal material in which the head has a concave portion having a bottom surface and being surrounded by a convex portion in the backside portion of the face portion, at least the convex portion and the concave portion are formed integrally and at least a part of the bottom surface of the concave portion is a mirror surface; wherein the mirror surface is formed through plastic working of the bottom surface.

2. A method for manufacturing an iron golf club head according to claim 1, wherein the mirror surface is obtained through press working with a die having a surface roughness finer than the mirror surface for which treatment for making a mirror surface is to be performed.

3. A method for manufacturing an iron golf club head according to claim 2, wherein a die face with treatment for making a mirror surface applied is provided in the die of the backside of the head for forming an iron golf club, press working is performed with the die face and the die face of the movable die on the side of the face portion and the die face with treatment for making a mirror surface applied applies treatment for making a mirror surface on the backside portion, and wherein a liner member is provided in the die face of the die of the backside of the head so as to be movable relative thereto forward and backward and the press working is performed on the bottom surface with the liner member to apply treatment for making a mirror surface on the backside portion.

4. A method for manufacturing an iron golf club head according to claim 1, wherein the mirror surface is formed on a part of the bottom portion and the mirror surface has a surface having a value no less than 400 GU in 20° according to JIS Z8741 which defines standards for glossiness of a mirror surface and measurement of glossiness.

* * * * *